US009212800B2

(12) United States Patent
Tanaka

(10) Patent No.: US 9,212,800 B2
(45) Date of Patent: Dec. 15, 2015

(54) VEHICULAR LAMP

(71) Applicant: KOITO MANUFACTURING CO., LTD., Minato-ku, Tokyo (JP)

(72) Inventor: Hidetada Tanaka, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 14/252,020

(22) Filed: Apr. 14, 2014

(65) Prior Publication Data

US 2014/0313755 A1 Oct. 23, 2014

(30) Foreign Application Priority Data

Apr. 22, 2013 (JP) ..... 2013-089338

(51) Int. Cl.
*F21V 14/04* (2006.01)
*F21S 8/10* (2006.01)

(52) U.S. Cl.
CPC ..... *F21S 48/1305* (2013.01); *F21S 48/1104* (2013.01); *F21S 48/1131* (2013.01); *F21S 48/1159* (2013.01); *F21S 48/1216* (2013.01); *F21S 48/1258* (2013.01); *F21S 48/137* (2013.01); *F21S 48/1317* (2013.01); *F21S 48/1747* (2013.01); *F21S 48/1757* (2013.01); *F21S 48/328* (2013.01)

(58) Field of Classification Search
CPC ..... F21S 48/1305; F21S 48/1323; F21S 48/1757; F21S 48/215; F21S 48/232; F21S 48/1159; F21V 17/02; F21V 14/04; B60Q 1/2696
See application file for complete search history.

(56) References Cited

U.S. PATENT DOCUMENTS

| | | | | |
|---|---|---|---|---|
| 6,183,100 | B1 * | 2/2001 | Suckow et al. | 362/35 |
| 2007/0019432 | A1 * | 1/2007 | Shimada | 362/545 |
| 2009/0046474 | A1 * | 2/2009 | Sato et al. | 362/466 |

FOREIGN PATENT DOCUMENTS

| | | | |
|---|---|---|---|
| JP | 2009-224039 | A | 10/2009 |
| JP | 2012-227102 | A | 11/2012 |

* cited by examiner

*Primary Examiner* — Y M Lee
(74) *Attorney, Agent, or Firm* — Sughrue Mion, PLLC

(57) ABSTRACT

A vehicular lamp includes: a movable reflector that has a reflecting surface and changes a direction of reflected light from the reflecting surface, according to an operating position thereof; a first light-emitting unit that emits light toward the reflecting surface; a second light-emitting unit that emits light toward the reflecting surface, from a position different from that of the first light-emitting unit; and a light control member that collects and projects the reflected light.

8 Claims, 9 Drawing Sheets

VEHICULAR LAMP

INCORPORATION BY REFERENCE

The disclosure of Japanese Patent Application No. 2013-089338 filed on Apr. 22, 2013 including the specification, drawings and abstract is incorporated herein by reference in its entirety.

BACKGROUND OF THE INVENTION

1. Field of the Invention

The invention relates to a vehicular lamp.

2. Description of Related Art

Known examples of vehicle lamps include those capable of scanning with radiated light, as described in, for example, Japanese Patent Application Publication No. 2009-224039 (JP 2009-224039 A) and Japanese Patent Application Publication No. 2012-227102 (JP 2012-227102 A). In JP 2009-224039 A, a technology of realizing so-called ADB (Adaptive Driving Beam) function (control of light distribution pattern adapted for running circumstances) by performing ON/OFF control of a light source in accordance with scanning movement while scanning with projected light is described. Also, in JP 2012-227102 A, a technology of realizing the function of controlling a light distribution pattern by performing ON/OFF control of a light source in accordance with scanning movement while scanning with projected light is described.

The vehicular lamps are not only required to have the function of radiating light, but also desired to have an additional function or functions, for improvement in the functionality. On the other hand, it is also desired to avoid increasing the size of the lamp.

SUMMARY OF THE INVENTION

The invention provides a vehicular lamp that achieves both improvement in the functionality and suppression of increase in the size thereof.

A vehicular lamp according to one aspect of the invention includes: a movable reflector that has a reflecting surface and changes a direction of reflected light from the reflecting surface, according to an operating position thereof; a first light-emitting unit that emits light toward the reflecting surface; a second light-emitting unit that emits light toward the reflecting surface, from a position different from that of the first light-emitting unit; and a light control member that collects and projects the reflected light.

With the above arrangement, the first light-emitting unit and the second light-emitting unit share the movable reflector and scanning with two beams of light emitted from the first light-emitting unit and the second light-emitting unit is conducted according to movement of the movable reflector. Thus, according to the invention, it is possible to achieve both improvement in the functionality and suppression of increase in the size thereof.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A vehicular lamp according to one embodiment of the invention will be described with reference to the drawings. The vehicular lamp of this invention may be used as various types of lamps provided in a vehicle. In one example as described below, this invention is applied to a vehicular headlamp. In the following description, the vertical direction, front-back direction, and lateral direction correspond to the vertical direction, longitudinal direction, and lateral direction of the vehicle, respectively.

Figure 1:
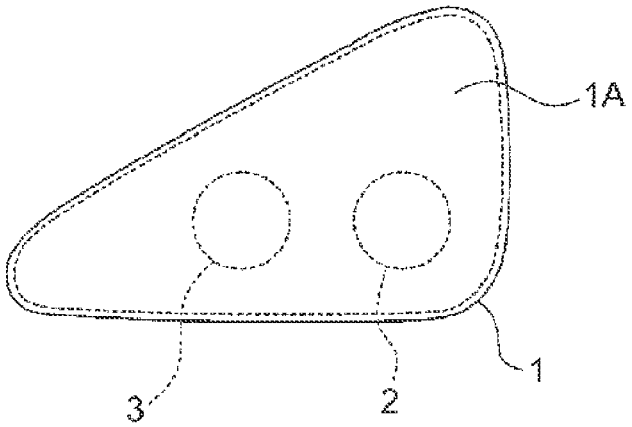
FIG. 1 is a schematic front view of a vehicular lamp according to one embodiment of the invention.
Figure 2:
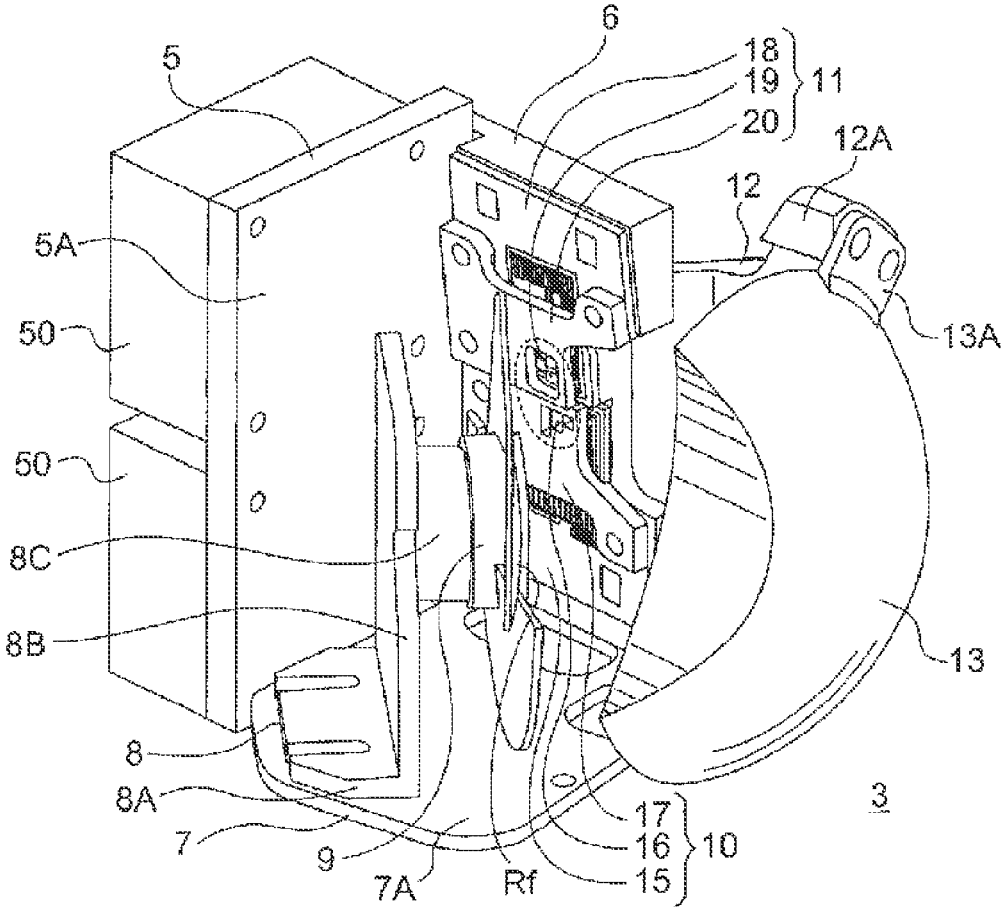
FIG. 2 is a schematic perspective view of a lamp unit included in the vehicular lamp.
Figure 3:
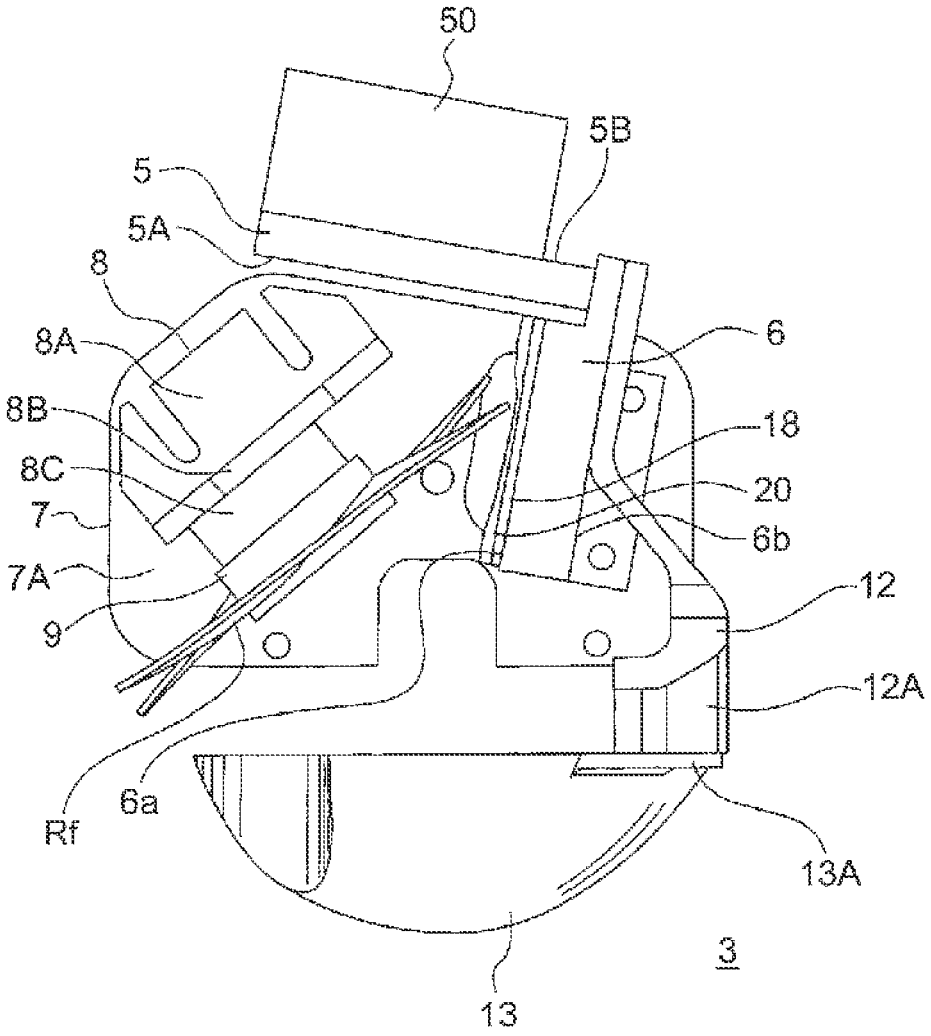
FIG. 3 is a schematic plan view of the lamp unit.

FIG. 1 is a schematic front view of the vehicular lamp 1 of this embodiment. The vehicular lamp 1 serving as a vehicular headlamp has a housing that consists of a lamp housing and a cover, and a lamp chamber 1A is formed within the housing. A first lamp unit 2 and a second lamp unit 3 are provided in the lamp chamber 1A. The first lamp unit 2 is a low-beam lamp unit. The first lamp unit 2 is not directly related with this invention, and any configuration or arrangement may be employed for the first lamp unit 2. The second lamp unit 3 is a lamp unit for radiating (projecting) scanning light to the front of the vehicle according to this invention.

As shown in FIG. 2 through FIG. 5, the second lamp unit 3 includes a vertical base 5, a first bracket 6 mounted on the vertical base 5, a bottom base 7 on which the first bracket 6 is mounted, a second bracket 8 mounted on the bottom base 7, a rotary reflector 9 that is rotatably supported by the second bracket 8, first light-emitting unit 10 and second light-emitting unit 11 mounted on the first bracket 6, a lens holder 12 mounted on the first bracket 6, and a projection lens 13 held by the lens holder 12.

The vertical base 5 is a rectangular plate member having a front surface 5A that face forward and a back surface 5B that face backward. Heat sinks 50, 50 are mounted on the back surface 5B of the vertical base 5. The heat sinks 50, 50 serve to release heat generated when light is emitted from a first light-emitting portion 16 and a second light-emitting portion 19 which will be described later.

The first bracket 6 is a generally rectangular plate member having side surfaces 6*a*, 6*b* that face in the lateral direction, and a rear end portion of the first bracket 6 is attached to one side portion of the vertical base 5.

The first light-emitting unit 10 and the second light-emitting unit 11 are mounted on one side surface 6*a* of the first bracket 6. The first light-emitting unit 10 includes a first base plate 15 joined to the first bracket 6, first light-emitting portion 16 disposed on the first base plate 15, and a reflector forming member 17 mounted on the first base plate 15. The second light-emitting unit 11 includes a second base plate 18 joined to the first bracket 6, second light-emitting portion 19 disposed on the second base plate 18, and a shade 20 mounted on the second base plate 18. The second light-emitting unit 11 is located above the first light-emitting unit 10.

Figure 4:
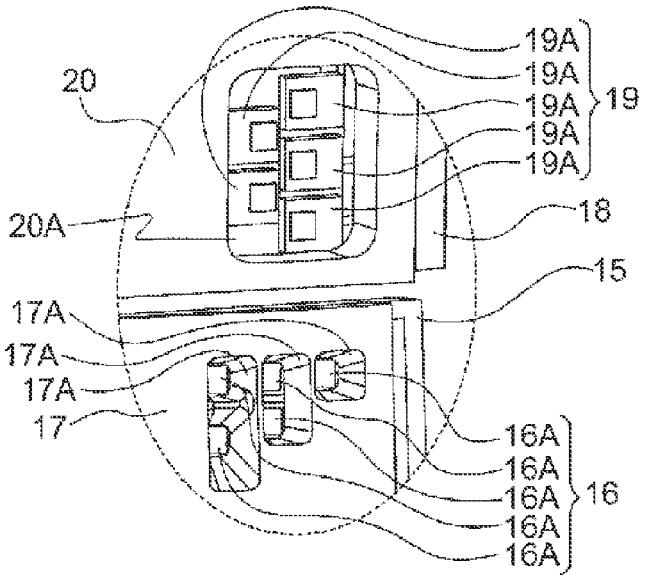
FIG. 4 is an enlarged view of a portion of the lamp unit associated with light emission.

As shown in FIG. 4, the first light-emitting portion 16 of the first light-emitting unit 10 includes a plurality of semiconductor light-emitting devices 16A, 16A, . . . . In this embodiment, LEDs (light-emitting diodes) are used as the semiconductor light-emitting devices 16A, 16A, . . . , and the color of the emitted light is, for example, white. The number of the semiconductor light-emitting devices 16A, 16A, . . . that constitute the first light-emitting portion 16 is, for example, five, and the semiconductor light-emitting devices 16A are arranged in three rows, for example. More specifically, the semiconductor light-emitting devices 16A are divided into a first set having two devices, a second set having two devices, and a third set having one device, and these first, second and third sets are arranged side by side.

Reflectors 17A are formed in the reflector forming member 17. In this embodiment, three reflectors 17A are formed which correspond to the respective rows of the semiconductor light-emitting devices 16A in the first light-emitting portion 16. The reflectors 17A, 17A, 17A are formed by forming recesses in the reflector forming member 17 such that walls that define the recesses provide reflecting surfaces. The reflectors 17A, 17A, 17A reflect light beams emitted from the corresponding semiconductor light-emitting devices 16A, so that the amount of light and light distribution pattern in connection with the first light-emitting portion 16 can be controlled.

The second light-emitting portion 19 of the second light-emitting unit 11 includes a plurality of semiconductor light-emitting devices 19A, 19A, . . . . In this embodiment, LEDs are used as the semiconductor light-emitting devices 19A, 19A, . . . , and the number of these devices is, for example, five. The semiconductor light-emitting devices 19A, 19A, . . . emit light having a different color from that of light emitted from other light sources (the first light-emitting portion 16 and a light source included in the lamp unit 2 that radiates low beams). In this embodiment, the color of the light emitted by the semiconductor light-emitting devices 19A, 19A, . . . is, for example, orange. In this connection, light emitted by the light source of the lamp unit 2 has the same color, e.g., white, as the color of light emitted by the first light-emitting portion 16.

In the second light-emitting portion 19, the semiconductor light-emitting devices 19A, 19A, . . . are arranged in two rows, for example. More specifically, the semiconductor light-emitting devices 19A are divided into a first set having two devices, and a second set having three devices, and the first and second sets are arranged side by side. A specific arrangement pattern of the semiconductor light-emitting devices 19A, 19A, . . . in this embodiment will be described later.

The shade 20 is provided for shielding an outer peripheral portion of diverging light emitted from the second light-emitting portion 19. An opening 20A that permits the light emitted from the second light-emitting portion 19 to pass therethrough is formed in the shade 20. With the shade 20 thus provided, the light emitted from the second light-emitting portion 19 is less likely to be directly received by the projection lens 13 (without passing the rotary reflector 9). Also, with the shade 20 thus provided, broadening of a beam of light emitted by the second light-emitting portion 19 can be limited, which is preferable for improvement in the sharpness of an image drawn with the light beam, using the drawing function as will be described later.

Figure 5:
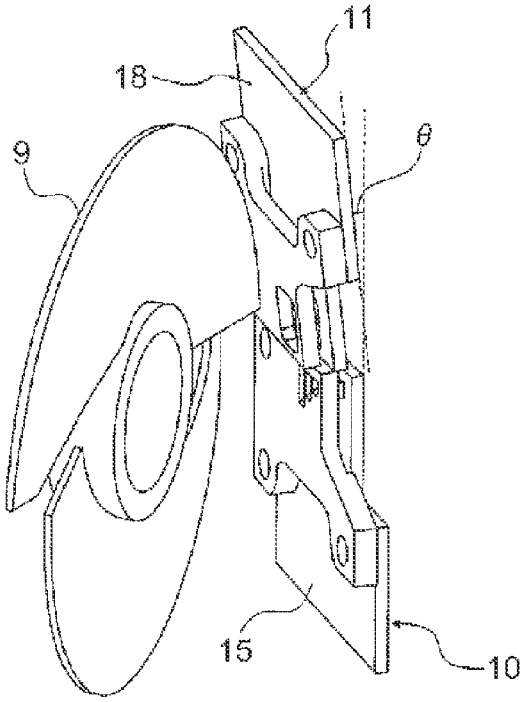
FIG. 5 is a schematic perspective view showing selected components of the lamp unit for realizing scanning with light.

As shown in FIG. 5, the second light-emitting unit 11 is inclined by a predetermined angle θ relative to the installation angle of the first light-emitting unit 10. More specifically, the first light-emitting unit 10 is installed in the vertical direction, whereas the second light-emitting unit 11 is installed to be inclined downward by the angle θ relative to the vertical direction. Accordingly, the light-emitting surface of the second light-emitting portion 19 (the light-emitting surface of each semiconductor light-emitting device 19A) is inclined downward by the angle θ, relative to the light-emitting surface of the first light-emitting portion 16 (the light-emitting surface of each semiconductor light-emitting device 16A). In this embodiment, a mounting surface of the first bracket 6 on which the second light-emitting unit 11 is mounted is inclined downward by the angle θ relative to the vertical direction, and the second base plate 18 is joined to the inclined surface, so that the light-emitting surface of the second light-emitting portion 19 is inclined downward by the angle θ.

A part of the lens holder 12 is mounted on the other side surface 6*b* of the first bracket 6, and a front end portion of the lens holder 12 is formed as a lens mounting portion 12A for mounting the projection lens 13 in position.

The projection lens 13 is a convex lens. In this embodiment, a planoconvex lens is used as the projection lens 13. A mounted portion 13A is formed at a predetermined position of an outer edge portion of the projection lens 13, and the mounted portion 13A is mounted on the lens mounting portion 12A, so that the projection lens 13 is held by the lens holder 12. The mounted portion 13A is mounted on to the lens mounting portion 12A, so that the convex surface of the projection lens 13 faces forward.

The bottom base 7 is a generally rectangular plate member having an upper surface 7A that faces upward, and a lower surface that faces downward. The first bracket 6 and the second bracket 8 are mounted on the upper surface 7A.

The second bracket 8 is formed by bending a generally rectangular plate member 90° into a generally L shape. The second bracket 8 has a bottom portion 8A that provides a base portion of the L shape, and a back portion 8B that provides a back portion of the L shape. The bottom portion 8A of the second bracket 8 is mounted on the upper surface 7A of the bottom base 7.

A mounting portion 8C for mounting the rotary reflector 9 in position is formed on the back portion 8B of the second bracket 8. The mounting portion 8C is formed in a generally cylindrical shape, and a motor (not shown) for rotating the rotary reflector 9 is held inside the mounting portion 8C. The rotary reflector 9 is mounted on a rotating shaft of the motor. The rotary reflector 9 is able to rotate about the rotating shaft of the motor (whose axis is coincident an axis of rotation R as described later referring to FIG. 8), and is positioned such that the axis of rotation R is inclined relative to the optical axes (ax1, ax2) of light beams emitted by the first light-emitting portion 16 and the second light-emitting portion 19.

Figure 6:
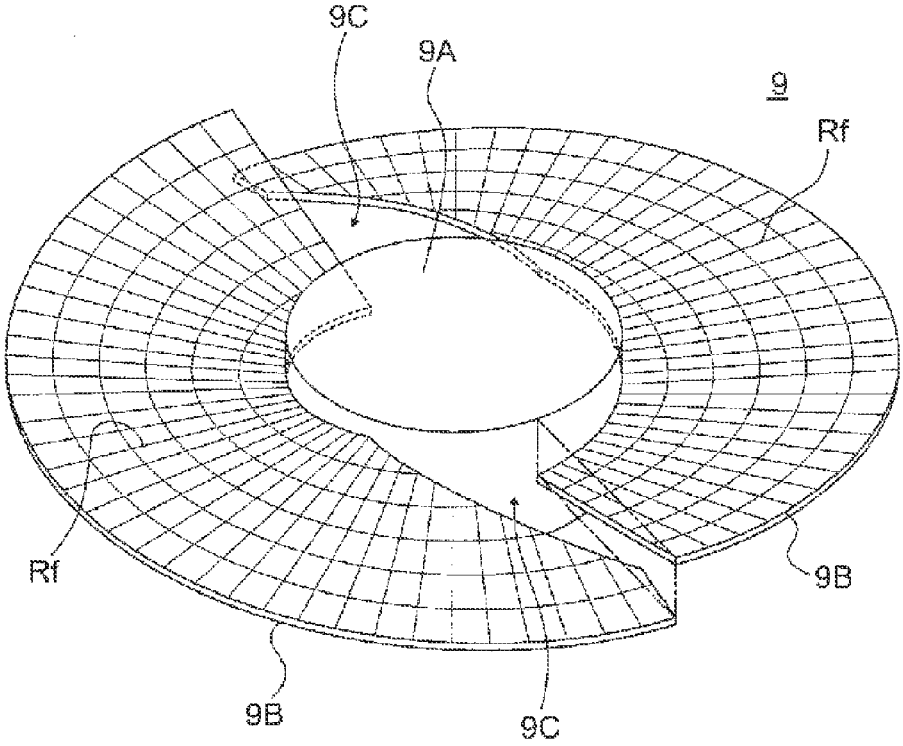
FIG. 6 is a perspective view of a rotary reflector.
Figure 7:
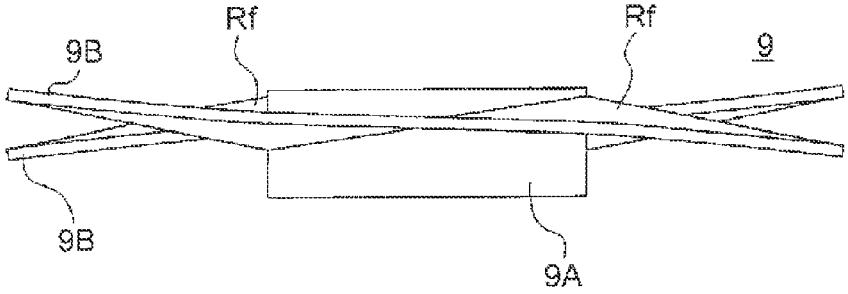
FIG. 7 is a side view of the rotary reflector.

As shown in FIG. 6 and FIG. 7, the rotary reflector 9 has a cylindrical rotation base portion 9A located in a central portion thereof, and two wing portions 9B, 9B that protrude outward from an outer circumferential surface of the rotation base portion 9A. The wing portions 9B, 9B have the same plate shape. Respective surfaces of the wing portions 9B, 9B are formed as reflecting surfaces Rf.

In the rotary reflector 9, gaps 9C, 9C are provided between the wing portions 9B, 9B in the circumferential direction. The reason for providing the gaps 9C, 9C will be described later.

The rotary reflector 9 serves to reflect light beams emitted by the first light-emitting portion 16 and the second light-emitting portion 19, at the reflecting surfaces Rf, so that the reflected light falls on the projection lens 13. The rotary reflector 9 is configured to change the direction of the reflected light, according to the rotational position thereof.

The reflecting surface Rf of each of the wing portions 9B is formed in a predetermined shape so as to realize scanning with light emitted from the first light-emitting portion 16 and the second light-emitting portion 19. Specifically, the reflecting surface Rf is formed in a twisted shape similar to that of a blade 26*a* described in JP 2012-227102 A as identified above. More specifically, where optical axis ax1 denotes the optical axis of light emitted by the first light-emitting portion 16, and optical axis ax2 denotes the optical axis of light emitted by the second light-emitting portion 19, the twisted shape of the reflecting surface Rf is determined so that the angle formed by each of the optical axes ax1, ax2 and the reflecting surface Rf as measured in a plane parallel to the horizontal plane changes in accordance with rotation of the wing portion 9B.

Figure 8:
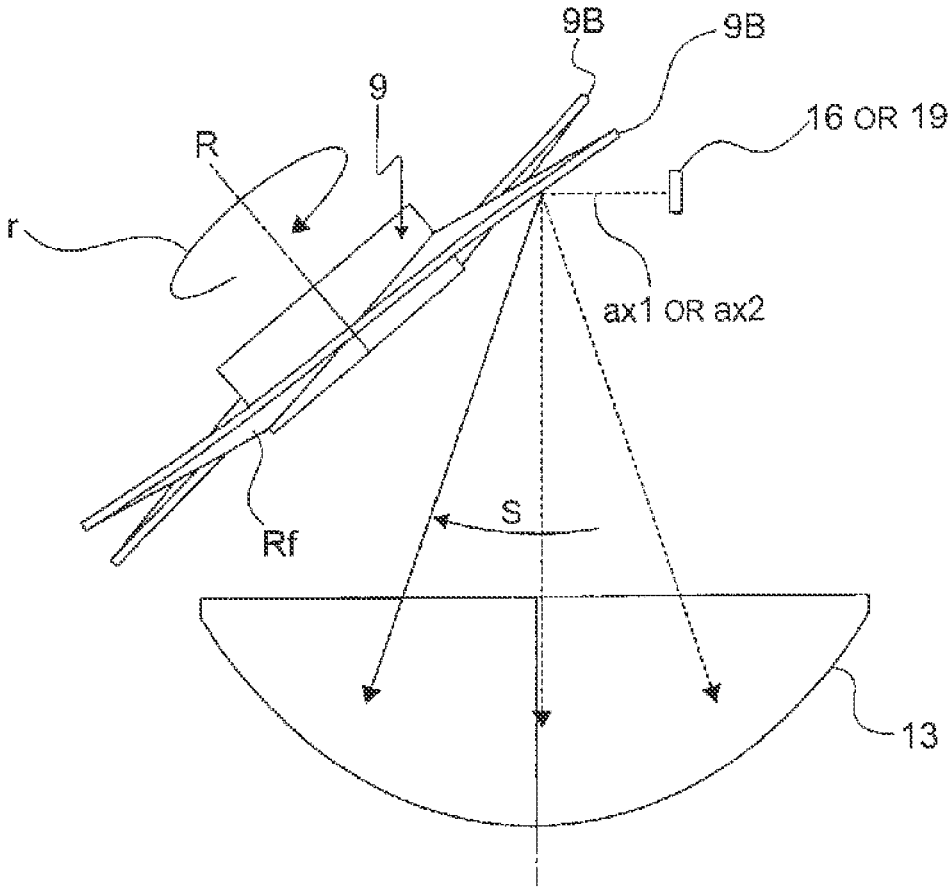
FIG. 8 is a view useful for explaining scanning with light realized by rotation of the rotary reflector.

FIG. 8 is a view useful for explaining scanning of light, which is realized by rotation of the rotary reflector 9, and schematically shows the positional relationship among the first light-emitting portion 16, second light-emitting portion 19, rotary reflector 9 and the projection lens 13 when the second lamp unit 3 is looked down from above, and the optical axis ax1 and optical axis ax2. Since the positional relationship of the first light-emitting portion 16 relative to the rotary reflector 9 is similar to that of the second light-emitting portion 19 when the second lamp unit 3 is looked down from above, the first light-emitting portion 16 and the second light-emitting portion 19 are represented by a single portion, and the optical axis ax1 and the optical axis ax2 are represented by a single line (axis).

As the motor as described above is driven, the rotary reflector 9 is rotated in a direction denoted by arrow r in FIG. 8, for example, about the axis of rotation R as the center of rotation. As the rotary reflector 9 is rotated, the angle formed by the optical axis ax1, ax2 and the reflecting surface Rf in a plane parallel to the horizontal plane changes according to the rotational position of the reflector 9. Therefore, in accordance with rotation of the rotary reflector 9, the optical axis ax1, ax2 shifts as if it swings in the plane parallel to the horizontal plane, as indicated by arrow s in FIG. 8, so that scanning (sweep) with the light beams respectively emitted from the first light-emitting portion 16 and the second light-emitting portions 19 are conducted in the horizontal direction. In this embodiment, one scanning is conducted for one sheet of wing portion 9B.

In the vehicular lamp 1 of this embodiment constructed as described above, the first light-emitting portion 16 is a high-beam light source, and radiates light to a far point in the upward direction. By scanning with the light emitted by the first light-emitting portion 16 as the high-beam light source in the manner as shown in FIG. 8, the ADB function can be carried out. The ADB function is a function of forming a non-irradiated area of light in a part of high-beam light distribution area, so that an object, such as a leading vehicle or an oncoming vehicle (vehicle coming in the opposite direction), which it is undesirable to irradiate with high beams, is prevented from being irradiated with the light.

Figure 9A:
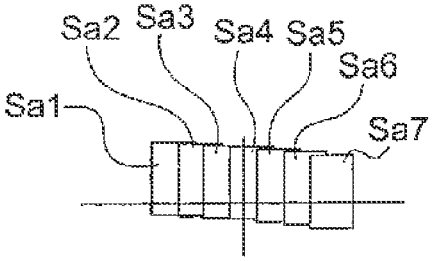
FIG. 9A and FIG. 9B are views useful for explaining the ADB function.
Figure 9B:
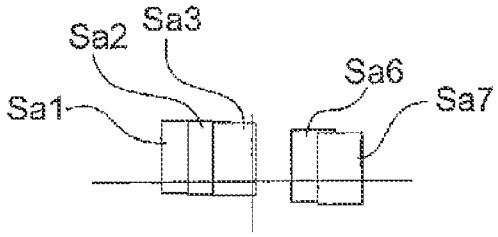

FIG. 9A and FIG. 9B are views useful for explaining the ADB function. FIG. 9A schematically shows the manner in which a light distribution area Sa formed when the light emitted by the first light-emitting portion 16 as the light source is radiated to the front of the vehicle via the projection lens 13 shifts in the horizontal direction through the scanning operation. In FIG. 9A, light distribution areas Sa1-Sa7 formed at respective points t in time, i.e., time t1-time t7 into which the time required for completing one scanning is divided, are illustrated. If the first light-emitting portion 16 is kept turned on during scanning operation, the total area into which all of the light distribution areas Sa1-Sa7 are combined is visually recognized by human eyes as a high-beam light distribution area. This is achieved by setting the scan frequency to such a high level that an effect of residual images seen by human eyes can be obtained so as to accomplish the ADB function.

FIG. 9B shows an example in which the first light-emitting portion 16 is turned off for a period from a point immediately after time t3 to a point immediately before time t6 during scanning operation, so that a non-irradiated area of light is formed between the light distribution area Sa3 and the light distribution area Sa6. By turning off the first light-emitting portion 16 in specified timing during scanning of light, the non-irradiated area of light can be formed in a certain part of the high-beam light distribution area. Thus, the ADB function is realized by performing light turn-on/turn-off control on the first light-emitting portion 16 as the high-beam light source, in accordance with the light scanning operation, namely, the rotational movement of the rotary reflector 9.

Although not illustrated in the drawings, the non-irradiated area of light may be formed only on the upper side if only the semiconductor light-emitting devices 16A located on the upper side, for example, out of the semiconductor light-emitting devices 16A, 16A, . . . that constitute the first light-emitting portion 16, are turned off during scanning operation. As is understood from this point, the ADB function is not limited to the above arrangement of completely dividing or splitting the high-beam light distribution area into the left-side and right-side areas, as illustrated in FIG. 9B.

In the vehicular lamp 1 of this embodiment, not only scanning with the light emitted by the first light-emitting portion 16 as the high-beam light source as described above, but also scanning with the light emitted by the second light-emitting portion 19 as a light source, can be conducted by means of the rotary reflector 9. In this embodiment, the second light-emitting portion 19 serves as a light source for drawing images.

Figure 10A:
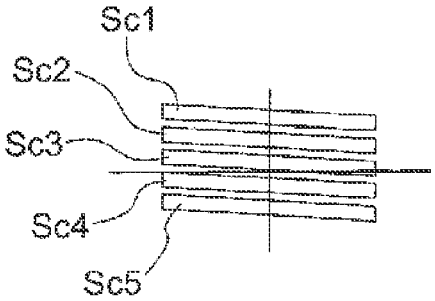
FIG. 10A-FIG. 10C are views useful for explaining the drawing function.
Figure 10B:
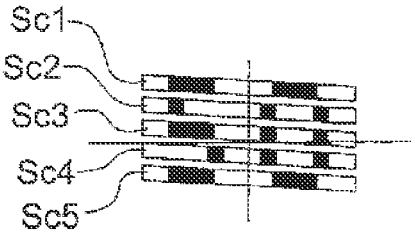
Figure 10C:
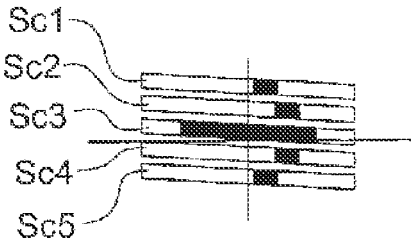

FIG. 10A to FIG. 10C are views useful for explaining the drawing function. FIG. 10A schematically shows scan ranges Sc1-Sc5 of light beams respectively emitted from light sources in the form of the semiconductor light-emitting devices 19A, 19A, . . . that constitute the second light-emitting portion 19. The drawing function is realized by performing light turn-on/turn-off control on each of the semiconductor light-emitting devices 19A in specified timing, during scanning with light caused by rotation of the rotary reflector 9. FIG. 10B and FIG. 10C illustrate examples in which images of "50" and "→" are drawn, respectively, through the light turn-on/turn-off control on each of the semiconductor light-emitting devices 19A as described above.

The drawing function as described above may be used for enabling the driver to visually recognize a certain mark during running of the vehicle, for example. In view of the use of the drawing function, it is desirable to draw an image by radiating light beams emitted from the semiconductor light-emitting devices 19A, 19A, . . . onto the road surface via the projection lens 13. In the vehicular lamp 1 of this embodiment, therefore, the second light-emitting portion 19 is located above the first light-emitting portion 16.

Figure 11:
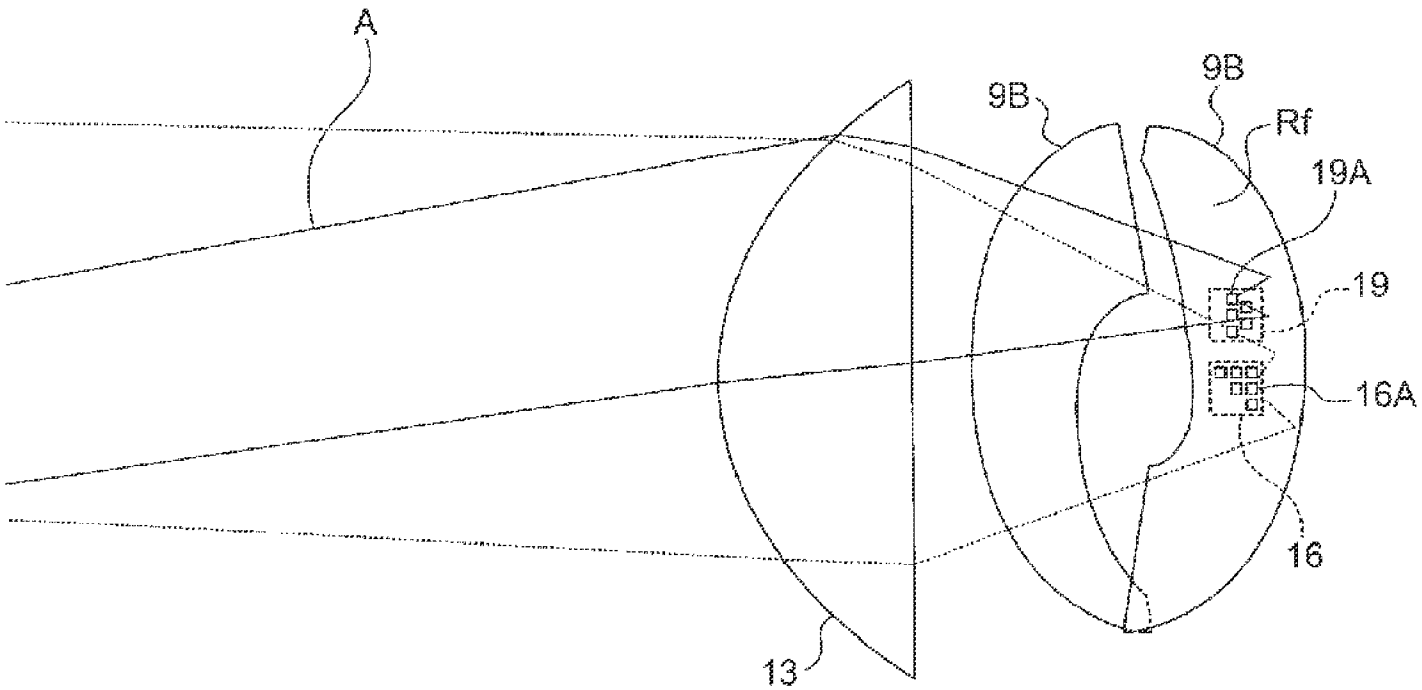
FIG. 11 is a view schematically showing paths of light beams emitted from a first light-emitting portion and a second light-emitting portion, respectively.

FIG. 11 schematically shows paths of light beams emitted from the first light-emitting portion 16 and the second light-emitting portion 19, respectively. In FIG. 11, light paths observed when the lamp unit 3 is seen from one side face thereof are illustrated. In FIG. 11, as typical examples of light beams emitted from the first light-emitting portion 16 and the second light-emitting portion 19, only the light beams emitted from one of the semiconductor light-emitting devices 16A and one of the semiconductor light-emitting devices 19A are illustrated. In FIG. 11, solid line A represents a path of light emitted from the second light-emitting portion 19.

In order to radiate light downward onto the road surface, the second light-emitting portion 19 needs to be located above the focal point of the projection lens 13 as the convex lens. This is because the projection lens 13 has a characteristic of projecting luminosity distribution (image) around the focal point forward while vertically and laterally reversing the distribution (image). It is desirable to locate the second light-emitting portion 19 above the first light-emitting portion 16 as described above, in order to locate the second light-emitting portion 19 above the focal point of the projection lens 13. It is also preferable to locate the second light-emitting portion 19 as described above, in order to achieve a function, such as a function of drawing an image on a road surface, which requires light to be radiated downward.

In this embodiment as described above, the second light-emitting portion 19 is inclined downward by the above-indicated angle θ. This angle θ is set to an angle corresponding to the curvature of field of the projection lens 13. It is preferable to incline the second light-emitting portion 19 downward by the angle corresponding to the field curvature of the projection lens 13, so as to reduce optical aberration in the projection lens 13 with respect to light emitted from the second light-emitting portion 19 as the light source.

In this embodiment, the first light-emitting portion 16 and the second light-emitting portion 19 are disposed at different positions, so that different portions of the reflecting surface Rf are irradiated with the light beams emitted from the first light-emitting portion 16 and the second light-emitting portion 19, respectively. This makes it easier to design the optical system for controlling the vertical directions of light beams emitted by the first light-emitting portion 16 and the second light-emitting portion 19 and projected via the reflecting surface Rf.

In the vehicular lamp 1, if the wing portions 9B, 9B of the rotary reflector 9 are irradiated with light at the same time, and two beams of light are projected onto the road surface at the same time, the drawing performance is undesirably deteriorated. Therefore, control for turning off the semiconductor light-emitting devices 19A, 19A, . . . is performed at the time of switching from scanning using one of the wing portions 9B to scanning using the other wing portion 9B. However, as a period of time for which the semiconductor light-emitting devices 19A, 19A, . . . are turned off is longer, the range of drawn image on the road surface is more likely to be narrowed, which may result in deterioration of the visibility or legibility of the image drawn on the road surface. Thus, in the vehicular lamp 1, the gaps 9C, 9C are provided between the wing portions 9B, 9B, as described above, and the semiconductor light-emitting devices 19A, 19A, . . . are turned off only for fixed periods of time for which light beams are directed toward the gaps 9C, 9C, so that the turn-off period is shortened. Thus, in the vehicular lamp 1, the turn-off period of the semiconductor light-emitting devices 19A, 19A is shortened while the wing portions 9B, 9B are prevented from being irradiated with light at the same time to project two beams of light, so that the drawing performance on the road surface can be improved, and the visibility of images drawn on the road surface can be improved.

In order to reduce the time for which both of the wing portions 9B are irradiated with light at the same time, "partition plates" as described in JP 2012-227102 A, for example, may be provided.

Figure 12:
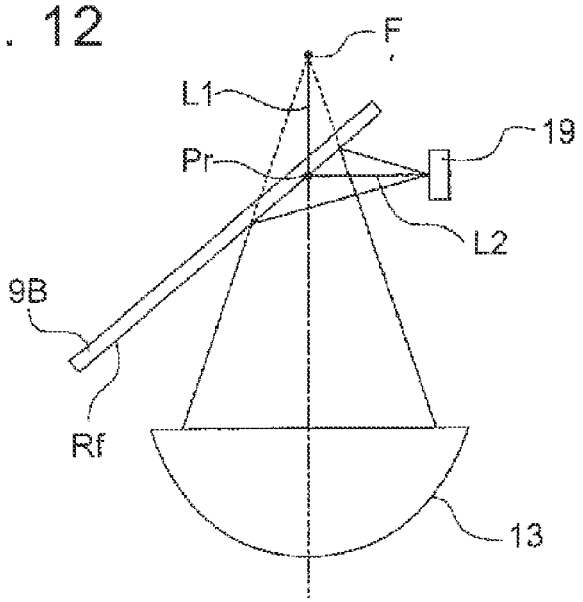
FIG. 12 is a view schematically showing the positional relationship among the second light-emitting portion, wing portion of the rotary reflector, and the projection lens, when the lamp unit is looked down from above.

In the vehicular lamp 1, it is desirable to place the focal point of the optical system on the second light-emitting portion 19 side in view of the drawing performance. The positional relationship among the second light-emitting portion 19, rotary reflector 9 and the projection lens 13 in this case will be described with reference to FIG. 12. In FIG. 12, focal point F represents the focal point of the projection lens 13. Point of intersection Pr denotes a point of intersection between the optical axis (ax2) of light emitted by the second light-emitting portion 19 and the reflecting surface Rf of the wing portion 9B. In this embodiment, the positional relationship among the second light-emitting portion 19, rotary reflector 9, and the projection lens 13 is set so that a distance L2 from the light-emitting surface of the second light-emitting portion 19 to the intersection point Pr coincides with a distance L1 from the intersection point Pr to the focal point F. By focusing the optical system on the second light-emitting portion 19 in this manner, it is possible to draw sharp images, thus assuring improved visibility of the drawn images and improved drawing performance.

In this connection, the optical system of the vehicular lamp 1 need not be focused on the first light-emitting portion 16, unlike the second light-emitting portion 19. In this case, the boundary between a high-beam irradiated area and a non-irradiated area created under the ADB function is blurred; therefore, the driver will not feel strange or uncomfortable.

Figure 13A:
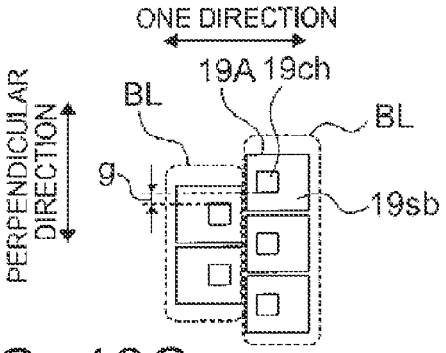
FIG. 13A-FIG. 13D are views useful for explaining the arrangement of semiconductor light-emitting devices.
Figure 13B:
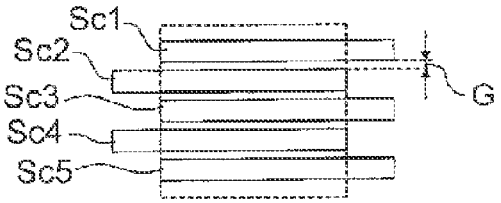

In the second light-emitting portion 19 of this embodiment, the semiconductor light-emitting devices 19A, 19A, . . . are divided into and arranged in two or more rows. As shown in FIG. 13A, 13B, the rows of the semiconductor light-emitting devices 19A in the second light-emitting portion 19 are respectively denoted as light-emitting blocks BL. Where the light-emitting blocks BL are defined in this manner, the second light-emitting portion 19 has two or more light-emitting blocks BL arranged adjacent to each other in one direction (horizontal direction). As described above, in this embodiment, five semiconductor light-emitting devices 19A, 19A, . . . are divided into a set of two devices and a set of three devices; therefore, in one of the light-emitting blocks BL, two semiconductor light-emitting devices 19A are arranged at a predetermined interval in a direction (vertical direction) perpendicular to the above-indicated one direction, while, in the other light-emitting block BL, three semiconductor light-emitting devices 19A are arranged at preddetermined intervals in the vertical direction. Then, in this embodiment, in the adjacent light-emitting blocks BL, BL, the semiconductor light-emitting devices 19A of one of the light-emitting blocks BL are positioned offset from the semiconductor light-emitting devices 19A of the other light-emitting block BL in direction perpendicular to the above-indicated one direction.

Figure 13C:
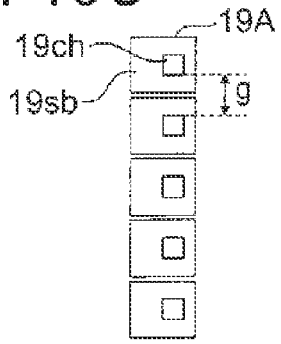
Figure 13D:
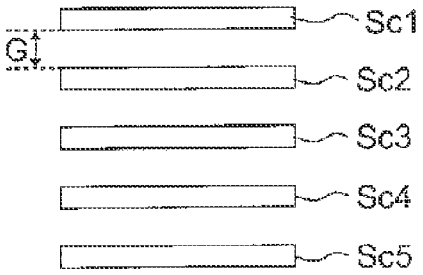

Each of the semiconductor light-emitting devices 19A has a chip 19*ch* having a light-emitting surface, and a substrate 19*sb* on which the chip 19*ch* is installed. If the semiconductor light-emitting devices 19A, 19A are arranged in one row in the vertical direction (perpendicular to the scanning direction), as shown in FIGS. 13C, 13D, the interval g of adjacent ones of the chips 19*ch* arranged in the vertical direction is relatively large, and the interval G of scan ranges Sc as measured in the vertical direction is also relatively large. Accordingly, the drawing performance may be deteriorated. On the other hand, according to the arrangement of the semiconductor light-emitting devices 19A, 19A, . . . in the above-described embodiment, the chips 19*ch* are arranged so that the vertical positions of the chips 19*ch* of one of the light-emitting blocks BL do not overlap the vertical positions of the chips 19*ch* of the other light-emitting block BL, as shown in FIGS. 13A, 13B; furthermore, the interval g of adjacent ones of the chips 19*ch* as measured in the vertical direction can be reduced. Accordingly, the interval G of the scan ranges Sc can also be reduced, and deterioration of the drawing performance can be curbed.

As described above, the vehicular lamp 1 of this embodiment includes the rotary reflector 9 that has the reflecting surface Rf and changes the direction of reflected light from the reflecting surface Rf in accordance with the operating position, the first light-emitting portion 16 that emits light toward the reflecting surface Rf, the second light-emitting portion 19 that emits light toward the reflecting surface RF, from a different position from the first light-emitting portion 16, and the projection lens (light control member) 13 that collects and projects the reflected light.

With the above arrangement, the first light-emitting portion 16 and the second light-emitting portion 19 share the rotary reflector 9 and scanning with two different beams of light is conducted due to movement of the common rotary reflector 9, so as to achieve two functions, e.g., the ADB function and the drawing function, as the functions that utilize scanning with light. Since there is no need to construct an optical system separately for each function so as to achieve the two functions, the size of the lamp is less likely to be increased. Accordingly, in this embodiment, the functionality of the vehicular lamp 1 can be improved, and the size of the lamp 1 is less likely to be increased.

Also, in the vehicular lamp 1 of this embodiment, the rotary reflector 9 is used as a movable reflector. The blower function is realized by rotary movement of the rotary reflector 9 (the rotary movement of the wing portions 9B, 9B), and a cooling effect against heat generated by the first light-emitting portion 16 and the second light-emitting portion 19 can be provided. Also, scanning with light is realized by simple movement like rotation; therefore, the lamp is less likely to be complicated in construction, and, in this point, too, the size of the lamp is less likely to be increased.

Further, in the vehicular lamp 1 of this embodiment, the first light-emitting portion 16 and the second light-emitting portion 19 emit light beams having different colors. Thus, the light beams having different colors are controlled and radiated by the projection lens 13. Accordingly, when an image is drawn with light emitted from one of the light-emitting portions, as in this embodiment, the visibility of the drawn image is favorably improved.

Also, in the vehicular lamp 1 of this embodiment, the first light-emitting portion 16 serves as a light-emitting portion for emitting high beams, and the second light-emitting portion 19 serves as a light-emitting portion for drawing images. Thus, the drawing function is added to the vehicular lamp 1 as a high-beam lamp, thus assuring improvement in the functionality.

While the rotary reflector 9 is provided with two wing portions 9B, 9B in the above-described embodiment, the number of wing portions 9B should not be limited to two. The number of wing portions 9B may be appropriately set, in view of about what length of time is required as a length of time for one scanning, for example.

Figure 14:
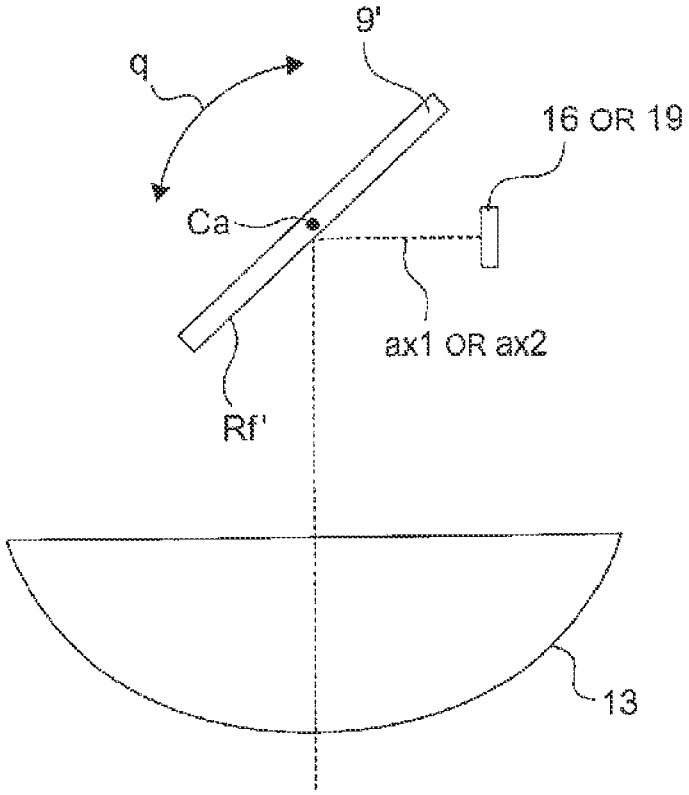
FIG. 14 is a view useful for explaining an oscillating reflector.

As the movable reflector, an oscillating reflector 9' as shown in the schematic view of FIG. 14 may be used, in place of the rotary reflector 9. The oscillating reflector 9' has a reflecting surface Rf', and oscillates in directions denoted by a double-headed arrow q in FIG. 14, about an axis Ca as a central axis. The reflecting surface Rf of the oscillating reflector 9' receives light beams emitted by the first light-emitting portion 16 and the second light-emitting portion 19, from different positions. The angle formed by the reflecting surface Rf' and the optical axis ax1, ax2 in a plane parallel to the horizontal plane changes, and the direction of the reflected light changes, according to the operating position of the oscillating reflector 9'. Accordingly, scanning with the light beams respectively emitted from the first light-emitting portion 16 and the second light-emitting portion 19 as light sources is conducted in the horizontal direction, according to the movement of the oscillating reflector 9'. When the oscillating reflector 9' is used, too, the blower function is realized, and the effect of cooling against heat generated by the first light-emitting portion 16 and the second light-emitting portion 19 can be provided. Also, since scanning with light is achieved by simple movement like oscillation, the lamp is less likely to be complicated in construction, and the size and cost of the lamp are less likely to be increased.

In the present invention, the movable reflector should not be limited to the rotary reflector 9 or the oscillating reflector 9'. Namely, the movable reflector according to the invention may be otherwise configured provided that the reflector has a reflecting surface, and changes the direction of reflected light from the reflecting surface according to the operating position.

Also, the projection lens 13 is not limited to the planoconvex lens, but a projection lens of another shape, such as an aspheric lens, may also be used. In another example, the scanning light may be projected via a light control member other than lenses. For example, a reflector having a reflecting surface formed in a generally conical shape may be provided, and the reflector may be arranged to collect and reflect light received from the reflecting surface of the movable reflector, so as to radiate (emit) the light.

While the first light-emitting portion 16 and the second light-emitting portion 19 are mounted on separate base plates in the above-described embodiment, the first light-emitting portion 16 and the second light-emitting portion 19 may be formed on the same base plate. While the second light-emitting portion 19 is inclined by the angle θ in the above-described embodiment, the second light-emitting portion 19 and the first light-emitting portion 16 may be installed with the angle θ equal to 0°, namely, with no angular difference provided. Thus, the construction can be simplified.

In the illustrated embodiment, the focal point of the projection lens 13 is placed on the second light-emitting portion 19, but not placed on the first light-emitting portion 16. However, the focal point of the projection lens 13 may be placed on the first light-emitting portion 16, but not be placed on the second light-emitting portion 19.

While the heat sinks 50 are mounted on the back surface of the vertical base 5 in the above-described embodiment, the mounting location of the heat sink 50 is not particularly limited; for example, the heat sink 50 may be mounted on the side surface 6*b* of the first bracket 6. With the above arrangement where the heat sinks 50 are mounted on the back surface of the vertical base 5, the lateral size of the lamp unit 3 is less likely to be increased. Accordingly, when two or more lamp units are arranged in the lateral direction as in the vehicular lamp 1, restrictions on the locations of the lamp units can be favorably reduced.

Also, the semiconductor light-emitting devices are not limited to LEDs, but other semiconductor light-emitting devices, such as EL (electroluminescence) devices, or LD (laser diode) devices, may also be used. In particular, the LD devices are characterized in that light emitted by the LD devices is less likely to spread out, and most of the emitted light falls within a relatively narrow range of 10°-40° with respect to the direction of emission. Therefore, when the LD devices are used in the first light-emitting portion 16, the reflector forming member 17 is not needed. Also, when the LD devices are used in the second light-emitting portion 19, the light use efficiency is improved, as one of its advantages.

While two functions, i.e., the ADB function and the drawing function, are illustrated as examples of functions utilizing scanning with light, in the above description, the invention may be favorably applied to the case where other functions replace these functions.

As described above, a vehicular lamp according to one aspect of the invention includes: a movable reflector that has a reflecting surface and changes a direction of reflected light from the reflecting surface, according to an operating position thereof; a first light-emitting unit that emits light toward the reflecting surface; a second light-emitting unit that emits light toward the reflecting surface, from a position different from that of the first light-emitting unit; and a light control member that collects and projects the reflected light.

With the above arrangement, the first light-emitting unit and the second light-emitting unit share the movable reflector and scanning with two beams of light emitted from the first light-emitting unit and the second light-emitting unit is conducted according to movement of the movable reflector.

The movable reflector may be a rotary reflector or an oscillating reflector. With this arrangement, the blower function is realized.

The light control member may be a convex lens, and the first light-emitting unit and the second light-emitting unit may be arranged in a vertical direction of a vehicle. With this arrangement, light emitted from the first light-emitting unit or the second light-emitting unit and reflected by the movable reflector can be radiated upward or downward.

The first light-emitting unit and the second light-emitting unit may emit light beams having different colors. With this arrangement, the light beams having different colors are controlled and radiated by the light control member.

The first light-emitting unit or the second light-emitting unit may comprise a plurality of light-emitting blocks each having at least one semiconductor light-emitting device, the plurality of light-emitting blocks may be located adjacent to each other in one direction, and at least one of the light-emitting blocks may have a plurality of semiconductor light-emitting devices arranged at a predetermined interval in a direction perpendicular to the one direction. In this case, in the light-emitting block having the plurality of semiconductor light-emitting devices and the light-emitting block located adjacent to the light-emitting block having the plurality of semiconductor light-emitting devices, the semiconductor light-emitting devices of one of the adjacent light-emitting blocks may be positioned offset from the semiconductor light-emitting devices of the other of the adjacent light-emitting blocks in the direction perpendicular to the one direction. With this arrangement, the interval of scanning light beams emitted from respective semiconductor light-emitting devices as light sources, as measured in the direction perpendicular to the scanning direction, can be narrowed.

The first light-emitting unit may be a light-emitting unit for high beams, and the second light-emitting unit may be a light-emitting unit for drawing an image. With this arrangement, the drawing function is added to the vehicle lamp as a high-beam lamp. In this case, the light control member may be a convex lens, and the second light-emitting unit may be located at an upper position in a vertical direction of a vehicle than the first light-emitting unit.

The movable reflector may be the rotary reflector, the movable reflector may have a plurality of wing portions each having a surface formed as the reflecting surface. In this case, each of the wing portions may have a twisted shape so that an angle formed by each of an optical axis of light emitted by the first light-emitting unit and an optical axis of light emitted by the second light-emitting unit, and the reflecting surface, in a plane parallel to a horizontal plane, changes in accordance with rotation of the wing portion.

What is claimed is:

1. A vehicular lamp comprising:

a movable reflector that has a reflecting surface and changes a direction of reflected light from the reflecting surface, according to an operating position thereof;

a first light-emitting unit that emits light toward the reflecting surface;

a second light-emitting unit that emits light toward the reflecting surface, from a position different from that of the first light-emitting unit; and a light control member that collects and projects the reflected light;

wherein the first light-emitting unit is a light-emitting unit for high beams, and the second light-emitting unit is a light-emitting unit for drawing an image;

the second light-emitting unit includes a plurality of semiconductor light-emitting devices, and an image is drawn by the second light-emitting unit by controlling turning on and off of the respective semiconductor light emitting devices in a specified timing.

2. The vehicular lamp according to claim 1, wherein the movable reflector is a rotary reflector or an oscillating reflector.

3. The vehicular lamp according to claim 1, wherein:

the light control member is a convex lens; and the first light-emitting unit and the second light-emitting unit are arranged in a vertical direction of a vehicle.

4. The vehicular lamp according to claim 1, wherein the first light-emitting unit and the second light-emitting unit emit light beams having different colors.

5. A vehicular lamp comprising:

a movable reflector that has a reflecting surface and changes a direction of reflected light from the reflecting surface, according to an operating position thereof;

a first light-emitting unit that emits light toward the reflecting surface;

a second light-emitting unit that emits light toward the reflecting surface, from a position different from that of the first light-emitting unit; and a light control member that collects and projects the reflected light; wherein:

the first light-emitting unit or the second light-emitting unit comprises a plurality of light-emitting blocks each having at least one semiconductor light-emitting device;

the plurality of light-emitting blocks are located adjacent to each other in one direction;

at least one of the light-emitting blocks has a plurality of semiconductor light-emitting devices arranged at a predetermined interval in a direction perpendicular to the one direction; and in the light-emitting block having the plurality of semiconductor light-emitting devices and the light-emitting block located adjacent to the light-emitting block having the plurality of semiconductor light-emitting devices, the semiconductor light-emitting devices of one of the adjacent light-emitting blocks are positioned offset from the semiconductor light-emitting devices of the other of the adjacent light-emitting blocks in the direction perpendicular to the one direction.

6. The vehicular lamp according to claim 1, wherein:

the light control member is a convex lens; and the second light-emitting unit is located at an upper position in a vertical direction of a vehicle than the first light-emitting unit.

7. The vehicular lamp according to claim 2, wherein the movable reflector is the rotary reflector;

the movable reflector has a plurality of wing portions each having a surface formed as the reflecting surface; and each of the wing portions has a twisted shape so that an angle formed by each of an optical axis of light emitted by the first light-emitting unit and an optical axis of light emitted by the second light-emitting unit, and the reflecting surface, in a plane parallel to a horizontal plane, changes in accordance with rotation of the wing portion.

8. A vehicular lamp comprising:

a movable reflector that has a reflecting surface and changes a direction of reflected light from the reflecting surface, according to an operating position thereof;

a first light-emitting unit that emits light toward the reflecting surface;

a second light-emitting unit that emits light toward the reflecting surface, from a position different from that of the first light-emitting unit; and a light control member that collects and projects the reflected light; wherein the movable reflector is a rotary reflector;

the movable reflector has a plurality of wing portions each having a surface formed as the reflecting surface;

each of the wing portions has a twisted shape so that an angle formed by each of an optical axis of light emitted by the first light-emitting unit and an optical axis of light emitted by the second light-emitting unit, and the reflecting surface, in a plane parallel to a horizontal plane, changes in accordance with rotation of the wing portion;

gaps are provided between adjacent ones of the wing portions; and the first light-emitting unit or the second light-emitting unit is configured to be turned off during a period in which light emitted from the first light-emitting unit or the second light-emitting unit is directed toward the gaps.

* * * * *